United States Patent [19]

Russell et al.

[11] Patent Number: 4,836,146

[45] Date of Patent: Jun. 6, 1989

[54] CONTROLLING RAPPING CYCLE

[75] Inventors: Paul F. Russell, Houston; Egon L. Doering, Pasadena; Clifford C. Segerstrom, Houston, all of Tex.; Jacob H. Stil; Gerd Harenslak, both of The Hague, Netherlands; Matheus M. van Kessel, Amsterdam, Netherlands

[73] Assignee: Shell Oil Company, Houston, Tex.

[21] Appl. No.: 195,939

[22] Filed: May 19, 1988

[51] Int. Cl.[4] ..... F22B 37/18; F22B 37/48

[52] U.S. Cl. ..... 122/379; 165/84; 165/95

[58] Field of Search ..... 165/1, 84, 95; 122/379

[56] References Cited

U.S. PATENT DOCUMENTS

| | | | |
|---|---|---|---|
| 3,680,531 | 8/1972 | Holdt | 122/379 |
| 3,785,351 | 1/1974 | Hall | 122/379 |
| 3,835,817 | 9/1974 | Tuomaala | 122/379 |
| 3,901,081 | 8/1975 | Adiutori | 73/357 |
| 3,997,000 | 12/1976 | Piela | 165/84 |
| 4,018,267 | 4/1977 | Tomasicchio | 165/84 |
| 4,047,972 | 9/1977 | Stumbar et al. | 134/2 |
| 4,139,461 | 2/1979 | Bauer | 210/63 |
| 4,466,383 | 8/1984 | Klatt et al. | 122/379 |
| 4,475,482 | 10/1984 | Moss et al. | 122/379 |
| 4,476,917 | 10/1984 | Otake et al. | 165/1 |
| 4,497,282 | 2/1985 | Nuendorfer | 122/379 |
| 4,653,578 | 3/1987 | Horming | 165/184 |
| 4,718,376 | 1/1988 | Leroueil et al. | 122/379 X |

*Primary Examiner*—Edward G. Favors

[57] ABSTRACT

The present invention is directed to a method and apparatus for controlling rapping of heat exchanging surfaces based on the heat transfer coefficient of the exchanger systems.

78 Claims, 2 Drawing Sheets

CONTROLLING RAPPING CYCLE

BACKGROUND OF THE INVENTION

Conventional systems for removing dust or scale deposited on heat exchanger surfaces in furnaces, boilers, etc., include soot blowing, mechanical rappers, and cleaning bodies, such as brushes, pigs or the like, passed through cooling tubes. Use of rappers to remove deposits is typically done based on a preselected cycle and frequency and with a preselected force.

However, maintaining the effectiveness of heat exchanger systems requires optimizing the removal of deposits to minimize the additional heat transfer resistance attributable to the equilibrium thickness of deposits on heat exchanging surfaces, which deposits can accumulate under changing conditions.

The present invention is directed towards optimizing the removal of deposits from heat exchanging surfaces in systems involving partial vaporization of water at the boiling point.

Applicants are not aware of any prior art which, in their judgment as persons skilled in this particular art, would anticipate or render obvious the present invention. However, for the purpose of fully developing the background of the invention, and establishing the state of requisite art, the following art is set forth: U.S. Pat. Nos. 4,476,917; 4,475,482; 3,680,531; 3,785,351; 4,018,267; 4,047,972; 3,901,081; 4,466,383 and 4,139,461.

SUMMARY OF THE INVENTION

The primary purpose of the present invention relates to controlling rapping of heat exchanging surfaces of an indirect heat transfer zone having fouling deposits thereon. In particular, this invention relates to controlling rapping of heat exchanging surfaces of an indirect heat transfer zone having fouling deposits, such as ash and soot, thereon within a synthesis gas system.

Preferably, such an apparatus includes means for feeding particulate solids and oxygen-containing gas into a gasifier, means for partially oxidizing the solids at an elevated temperature within the gasifier, means for producing product gas within the gasifier, means for passing the product gas after quenching with gas from the gasifier to a heat exchanging zone in gas flow communication with the gasifier, the zone comprising a plurality of sections, at least one of which sections is a one-or two-phase heat transfer section, and in which sections fouling deposits accumulate on the surface thereof at different rates in the various sections because of different conditions. Each section includes rappers for removing said fouling deposits. Preferably, the zone comprises at least one section adapted to generate superheated steam, and a lower temperature heat exchanging section, (a) means for removing heat from the product gas in the heat exchanging zone by an indirect heat transfer cooling system using steam and/or water, (b) means for determining the overall heat transfer coefficient of the heat transfer surfaces, including any fouling deposits thereon, for each section of the zone, the means for determining includes means for determining mass flow rates of the product gas and cooling system within the heat exchanging zone, means for determining temperatures of the product gas and cooling system within the heat exchanging zone, and means for determining heat fluxes of the product gas and cooling system within the heat exchanging zone, (c) means for determining the relative change of the overall heat transfer coefficient due to the change of the thickness of the fouling deposits for each section as a function of time, (d) means for comparing the relative change of overall heat transfer coefficient from (c) of each section with a preselected reference section, said reference section being the section of least fouling which is rapped based on its current overall heat transfer coefficient as compared to its initial overall heat transfer coefficient, (e) means for removing fouling deposits from each section of the zone using rapping means, the rapping means having separate and independently controllable rapping parameters for each section of the zone, and (f) means for adjusting the rapping parameters of each section of said zone based on (d), the means for adjusting includes one or more of (1) means for adjusting a time interval between rapping cycles between individual rappers in a section, (2) means for adjusting rapping force of individual rappers, (3) means for adjusting the number of strikes of an individual rapper in its cycle, (4) adjusting the time interval for rapping an individual rapper and (5) adjusting the time interval between complete rapping cycle of rappers in said section. Preferably, the rapping is done on line while the heat-exchanger zone is operating as such.

Preferably, such a method includes (a) feeding particulate solids and oxygen-containing gas into a reactor, (b) partially oxidizing the solids at an elevated temperature within the reactor, (c) producing product gas within the reactor, (d) passing the product gas from the reactor to a heat exchanging zone in gas flow communication with the reactor, the zone including at least one section adapted to generate superheated steam, and a lower temperature heat exchanging section, (e) removing heat from the product gas in the heat exchanging zone by indirect heat exchange with a heat transfer using cooling system of steam and/or water, said zone comprising a plurality of sections, at least one of which is a one- or two-phase heat transfer section, and in which sections, fouling deposits accumulate on the surfaces thereof the various sections at different rates because of different conditions; (f) determining the overall heat transfer coefficient of the heat transfer surfaces, including any fouling deposits thereon for each section of the zone, said determinig includes determining mass flow rates of the product gas and cooling system within the heat exchanging zone, determining temperatures of the product gas and cooling system within the heat exchanging zone, and determining heat fluxes of the product gas and cooling system either directly on the product gas side or on the coolant side within the heat exchanging zone, (g) determining the relative change of the overall heat transfer coefficient due to the change of the thickness of the fouling deposits for each section as a function of time, (h) comparing the relative change of the overall heat transfer coefficient from (c) of each section with a preselected reference section, said reference section being the section of least fouling which is rapped based on its current overall heat transfer coefficient as compared to its initial overall heat transfer coefficient; (i) removing the fouling deposits from each section of the zone using rapping means, the rapping means having separate and independently controllable rapping parameters for each section of the zone, and (k) adjusting the rapping parameters for each section of said zone, the adjusting includes one or more of (1) adjusting a time interval between rapping of individual rappers in a section of individual rappers (3), adjusting rapping force, adjusting the number of strikes of an individual rapper in its cycle, (4) adjusting the time interval for rapping and individual rapper and (5) adjusting the time interval between complete rapping cycle of rappers in said section.

The method and apparatus of the invention can also include the additional feature of rapping each section of the heat exchanger zone in an adjusted sequential cycle which includes rapping of the other sections of the zone based on the changes in the overall heat transfer coefficient due to the change of the thickness of the fouling deposits of each section compared to the other sections to optimize the rapping of the heat exchange zone, which can result in the optimization operation of the heat exchanging zone.

The various features of novelty which characterize the invention are pointed out with particularity in the claims forming a part of this disclosure. For a better understanding of this invention, its operating advantages and specific object obtained by its uses, reference may be made to the accompanying drawings and descriptive matter in which there are illustrated preferred embodiments of the invention.

DESCRIPTION OF A PREFERRED EMBODIMENT

Figure 1:
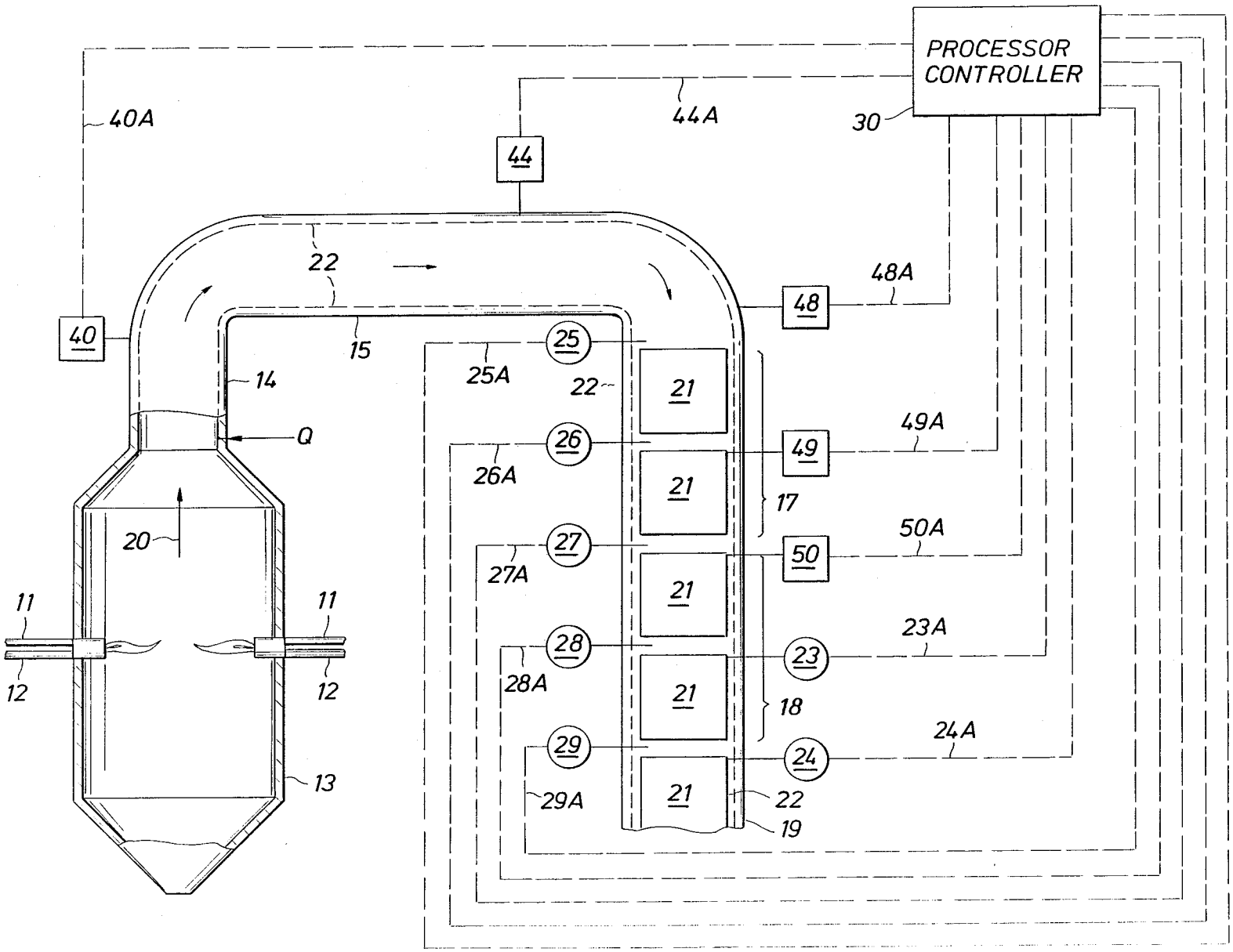
FIG. 1 illustrates a preferred embodiment of the present invention for optimizing rapping of heat exchange surfaces in a synthesis gas system.

Generation of synthesis gas occurs by partially combusting hydrocarbon fuel, such as coal, at relatively high temperatures in the range of about 1500° F. to about 3400° F. and at a pressure range of from about 1 to 200 bar in the presence of oxygen or oxygen-containing gases in a gasifier. Oxygen-containing gases include air, oxygen enriched air, and oxygen optionally diluted with steam, carbon dioxide and/or nitrogen.

In the present invention, the coal, fluidized and conveyed with a gas such as nitrogen, is discharged as fluidized fuel particles from a feed vessel apparatus, in communication with at least one burner associated with the gasifier. Typically, a gasifier will have burners in diametrically opposing positions. Generally, the burners have their discharge ends positioned to introduce the resulting flame and the agents of combustion into the gasifier.

Hot raw synthesis gas is quenched, usually with recycle synthesis gas, upon leaving the gasifier and passes to an indirect heat exchanger zone, said zone having diverse one- or two-phase heat transfer sections where boiler feed water is heated to the boiling point, vaporized and/or steam is superheated. The zone supplies dry superheated steam to a steam turbine, which drives an electrical generator. Of particular importance in the economic production of synthesis gas is the optimization of heat transfer of the zone.

Various factors substantially affect the heat transfer of the heat exchanger zone. In particular, fouling caused by the deposition of solids, fly ash and soot contained in the synthesis gas, on the heat transfer surfaces adversely affect the heat transfer of heat exchanger zone. It is desirable to remove these deposits by rapping in a controlled manner which takes into account that fouling deposits can accumulate in each section of the zone at different rates because of differences in conditions which occur in the sections of the zone.

The present invention utilizes a combination of heat transfer measurements in conjunction with process instrumentation to determine the overall heat transfer coefficient of each section of a one-phase or a two-phase, i.e., liquid and/or gas, indirect heat exchanging zone. In one embodiment of this present invention, the high (synthesis) gas temperature and gas composition prohibit accurate monitoring of heat transfer on the side being cooled above about 1200° F. to about 1400° F. by means of thermocouples. The present invention uses means other than by direct measurement of gas temperatures to determine the overall heat transfer coefficient from the quality of the steam-water mixtures of a two-phase heat exchanging zone such as by gamma ray densitometer, in these areas.

Additionally, the present invention permits controlling of the rapping of heat exchanging surfaces to remove fouling deposits therefrom. Controlling rapping is preferred to rapping based on a preselected cycle and frequency. Rapping too frequently can cause structural fatigue of the heat exchanging system. Also, when deposits are too thin, there is not enough internal force (i.e., not enough mass) to facilitate dislodging of deposits. Rapping too infrequently can make the deposits more difficult to remove because of sintering of the unremoved deposits caused by the high operating temperatures of the coal gasification process.

Another advantage of the present invention is the ability to separately and independently control rapping means for removing the fouling deposits from each section of the heat exchanging zone. Preferably, the means for removing deposits are operated sequentially beginning with the section closest to the reactor, and moving in the direction of synthesis gas flow.

Another advantage of the present invention is the ability to calculate the relative change of overall heat transfer coefficient of the heat transfer surfaces, including any fouling deposits thereon, for each section of the heat exchanging zone which adversely affects heat transfer.

A further advantage of the present invention is the capability of minimizing deposits on heat exchanging surfaces, while the heat exchanger is on line, which results in extended run lengths of gas cooling, e.g., in a coal gasification process, since significant fouling of the heat exchanger zone could otherwise require shutdown of the process to remove the fouling deposits.

Although in one embodiment the invention is described hereinafter primarily with reference to cooling gas resulting from the gasification of pulverized coal, the method and apparatus according to the invention are also suitable for other finely divided solid fuels which could be partially combusted in a gasifier, such as lignite, anthracite, bituminous, brown coal, soot, petroleum coke, and the like. Preferably, the size of solid carbonaceous fuel is such that 90 percent by weight of the fuel has a particle size smaller than No. 6 mesh (A.S.T.M.).

Having thus generally described the apparatus and method of the present invention, as well as its numerous advantages over the art, the following is a more detailed description thereof, given in accordance with specific reference to the drawings. However, the drawings are of a schematic process flow type in which auxiliary equipment, such as pumps, compressors, cleaning devices, etc., are not shown. All values are merely exemplary or calculated.

DETAILED DESCRIPTION OF THE DRAWING

Referring to FIG. 1 of the drawings, an apparatus for controlling rapping of heat exchanging surfaces having fouling deposits thereon, e.g., within a synthesis gas system, includes feeding particulate coal 11 and an oxygen-containing gas 12 into a gasifier 13. The coal is partially oxidized at elevated temperatures within the gasifier 13. A raw synthesis gas 20 is produced within the gasifier 13 having a temperature of from about 2000° F. to about 3000° F. The raw synthesis gas is passed from the gasifier 13 to a heat exchanging zone in gas flow communication with the gasifier 13. The zone can include the following major sections: a quench section 14 in which recycle synthesis gas is injected at Q for colling; an open duct section 15; and the superheater, evaporator and economizer sections, 17, 18, and 19, respectively. Each of sections 17, 18, and 19 can be subdivided into minor sections 21.

Heat is removed from the synthesis gas 20 in the heat exchanging zone by indirect heat exchange whereby a one- or two-phase circulating cooling system comprising steam and/or water, in some cases at a temperature of from above about 1200° F. to about 1600° F. and under various conditions. In some parts of the heat exchanging zone, the circulating coolant is contained in passages embedded in the surfaces 22 of the walls of the section 15 or 21. Additional circulating coolant can be contained in cylindrical bundles in the surfaces 22 within a section 21 of the heat exchange zone.

Figure 2:
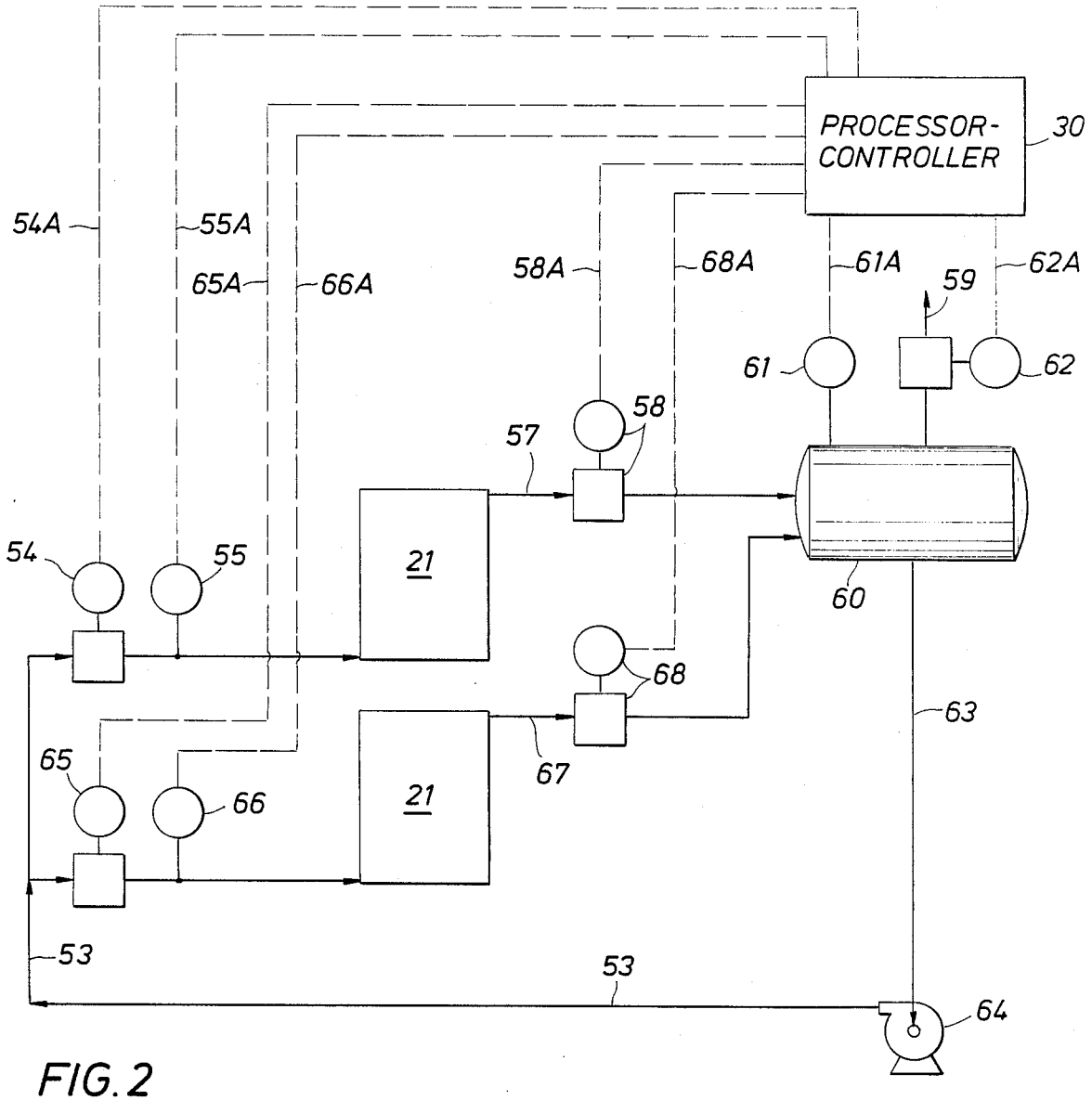
FIG. 2 illustrates a preferred embodiment of the apparatus for measuring the overall heat transfer coefficient of deposits within a bundle in heat exchanging section.

The overall heat transfer coefficient of the heat transfer surfaces, including any fouling deposits, for each section of the zone is determined by measuring the mass flow rates, temperatures, and heat fluxes of the synthesis gas and heat transfer cooling system within the various sections of said zone using units 23–29. Units 23–29 contain the instruments, such as flow meters, thermocouples, and gamma densitometers, needed to measure the flow rates, temperatures, steam quality, etc., and transmit the signals to the processor-controller 30. The units 23–29 represent the conglomeration of these devices. The units are shown one unit per section of the heat exchanging zone. However, it should be understood that even more than one unit per conventional heat exchanger section of the zone can be needed, although not shown. The number of units and type of devices depends on the configuration of the heat exchanger section and the coolant phase flow. FIG. 2, described later, is a more detailed description of a unit operating to determine the overall heat transfer resistance of a conventional heat exchange section with heat removal by partial evaporation of the coolant. In this case, a densitometer is used to determine the degree of vaporization of the coolant, and thereby determine the heat flux in that section. In other cases where the coolant phase does not change as it passes through the section, the temperature difference of the entering and leaving coolant is sufficient to determine the heat flux.

Another problem occurs in the quench and duct zones, where it is not possible to utilize thermocouples to determine the change in synthesis gas temperatures. In this case the gas temperatures at various heat exchanger section locations are calculated from the heat fluxes determined from the coolant system measurements, since the heat gained by the cooling system in this section is substantially identical to the heat lost from the synthesis gas in the same section.

It is difficult to measure heat flux in those sections where heat is removed by partial vaporization of liquid coolant, since there is little temperature change on the water-steam side of the cooling medium. However, a device for measuring the relative liquid and vapor fractions from gamma ray absorption can be used to measure the heat flux based on the different gamma ray absorption of vapor and liquid. For example, steam absorbs gamma rays much less effectively than water. The temperature of the (synthesis) gas being cooled can then be determined based on the fact that the heat gained by the steam/water cooling system is substantially identical to the heat lost from the (synthesis) gas being cooled.

Figure 3:
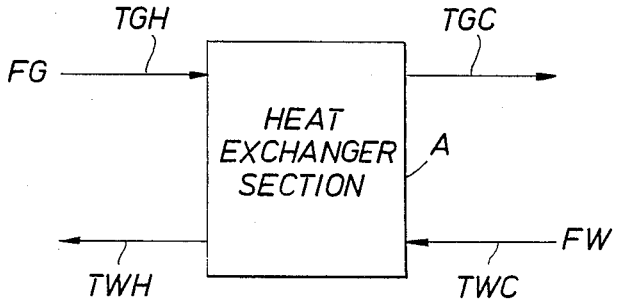
FIG. 3 illustrates a heat transfer section A and the relationships which produce the overall heat transfer coefficient of an individual section A of the heat exchanger zone.

The above-mentioned measurements can be transmitted to a processor-controller 30 via signals 23A–29A, and manipulated to yield the overall heat transfer coefficient of each individual section of the heat exchanger zone. The heat transfer coefficient (U) for a section A is generally calculated based on the relationships illustrated in FIG. 3 of the drawings.

Where $T$ = temperature
$F$ = mass flow rate
$G$ = synthesis gas
$W$ = coolant (water and/or gas)
$H$ = hot end
$C$ = cold end
$A$ = heat exchanger section area, sq. ft.

(Heat Flux) =
$(FG)$ * (Gas Heat Capacity) * $(TGH - TGC)/A$, BTU/(hr)(sq. ft.)

where $FG$ = Mass Flow of Synthesis Gas, lb/hr
$TGH$, $TGC$ are temperatures at the hot and cold ends, repectively.

Similarly, (Heat Flux) = $(FW) * (V) * (\lambda)/A$
(evaporating part only)

where $(FW)$ = Mass Flow of Coolant, lb/hr
$V$ = Mass fraction vaporized
$\lambda$ = Latent heat of vaporization, BTU/lb also, $DTH \equiv TGH - TWH$
$DTC \equiv TGC - TWC$
being the temperature differences between the synthesis gas and coolant at the hot and cold ends, respectively, and $(MTD) = \frac{(DTH - DTC)}{\ln (DTH/DTC)}$ (logrithmic mean temperature difference)

so $U = \frac{\text{(Heat Flux)}}{(MTD)}$ where $U$=Overall Heat Transfer Coefficient, BTU/(hr * sq. ft. * °F.)

The overall heat transfer coefficients and the relative change therein as a function of time for each section are thus continuously calculated by the process-controller. Changes in the overall heat transfer coefficients within a section may be due to differences in the thickness of the fouling deposits, which is the process variable we are attemping to minimize in the heat exchanging zone by manipulating the rapping variables. However, the overall heat transfer coefficients also change due to gas flow variations, including mass flow, temperature, pressure and composition. Some sections of the heat exchange zone incur only negligible heat transfer resistance due to fouling, hence almost any rapping sequence maintains them close to their initial performance. This makes it possible to discount the effect of gas flow variations upon the other heat transfer sections by forming the ratio of the other sections to such a section which does not change much due to fouling, and can be considered a reference section. The open duct section is useful as such a reference section.

Referring to FIG. 2 of the drawings, an apparatus for measuring the overall heat transfer coefficient of deposits for two evaporation sections 21 of an indirect heat exchanging zone includes processor-controller 30, which determines the overall heat transfer coefficient of the heat transfer surfaces, including any fouling deposits thereon, for each section and the relative change therein collectively of the zone. A cooling medium (e.g., steam or water) is passed via line 53 into a (venturi) flow meter 54 or the like to determine the mass flow of the medium and then is contacted with a thermocouple 55 or the like to determine the inlet temperature TWC of the medium and then through the inlet of heat exchanging section 21 where it comes into indirect heat exchange with hot synthesis gas and some or all of the remaining liquid of the two-phase cooling medium is converted into additional vapor. Cooling medium is removed from the section 21 via outlet line 57 and is then subjected to gamma ray detection with a densitometer 58 or the like for measuring the ratio of liquid and vapor fractions in the cooling medium needed to determine the outlet heat content of the medium. The medium is held in drum 60 where any steam is let off at line 59, the pressure is determined by a pressure device 61 and the mass flow rate is determined by flow meter device 62. The liquid coolant medium passes via line 63 into pump 64 for recycle via line 53. Signals 54A, 55A, 58A, 61A and 62A, respectively, from devices 54, 55, 58, 61, and 62, respectively, are transmitted to processor-controller 30. Similar means 65, 66, and 68 to determine the flow rates, temperatures, and the fraction of the cooling medium vaporized and to pass the signals 65A, 66A and 68A to the processor-controller are provided for other sections. A combined set of these means for measuring the cooling medium and the hot sythesis gas correspond to a single unit of the type sythesis gas correspond to a single unit of the type previously broadly described as unit 23 or the like.

Conventional systems optimizing indirect heat exchanger zone cleaning are usually based on observing the temperature of the synthesis gas exiting the heat exchanging zone. However, this does not account for the effects of changing conditions in the gasifier, which affect the velocity of the gas, gas composition, temperature and pressure and the like, which affect each section of a conventional heat exchanging zone. Hence, to account for these multiple effects not associated with fouling deposits, it is necessary to calculate the overall heat transfer coefficient for each section of the heat exchanging zone.

The relative change in overall heat transfer coefficient of the heat transfer surfaces, including any fouling deposits thereon, for each section is determined as a function of time by the processor-controller 30. The process-controller 30 compares the relative change of the overall heat transfer coefficient of a section with a preselected reference section.

The fouling deposits such as flyash and soot are removed using conventional rapping means, such as a mechanical rappers 40, 44 and 48–50, acoustical horns, or in any other manner well known to the art, preferably based on signals 40A, 44A and 48A–50A received from the processor-controller 30. Since the heat exchanging zone includes sections of different geometries, average temperature, flow velocities and water-side phase regimes (i.e., vapor superheating, partial vaporization, and liquid phase heating), it is expected that each section could have a different deposition rate. Therefore, it is desirable to have the rappers arranged having separate and independently controllable rapping parameters for each section of the zone controllable via processor-controller 30. The parameters include a time interval between rapping cycles between individual rappers in a section, rapping force, number of strikes of a rapper, rapping frequency of an individual rapper in its own cycle, time interval for rapping an individual rapper and time interval between complete rapping cycles of rappers in a section.

In the present invention, the separation of the particulate deposit from the impacted heat transfer surface requires a rapping force which is sufficient to overcome the adhesion between the deposit and the heat transfer surface, as well as any elastic force which may exist in a well formed, continuous layer of deposit. In addition, the force must be small enough not to cause structural fatigue over the intended service life of the heat transfer surface.

When an impact force is applied to a heat transfer surface, the surface vibrates in all of its normal modes, each mode having a different frequency and standing wave shape. Generally, the lower frequency modes have larger displacement maxima while the higher frequency have larger acceleration maxima. If the force is applied on a line of zero response for a particular mode, that mode will be very ineffectively excited. If the force is applied near the location of maximum response, that mode is effectively excited. When the structure is large and the force is small, the motion may decay rapidly with distance from the source, so that multiple excitation locations are necessary for effective cleaning motion. The present invention provides a means for determining the effects of vibration frequencies and mode shapes and rapper timing, forces, phases, locations, and numbers on both structural reliability and cleaning performance.

Although the system is shown in FIG. 1 in its distributed form as discrete components, it would be readily understood by those skilled in the art that these components could be combined into a single unit or otherwise implemented as may be most convenient for the particular application at hand.

The foregoing description of the invention is merely intended to be explanatory thereof, and various changes in the details of the described method and apparatus may be made within the scope of the appended claims without departing from the spirit of the invention.

What is claimed is:

1. A method for controlling the rapping of heat exchanging surfaces used to cool gas having fouling deposits thereon, said method comprising:

(a) removing heat from a gas in a heat exchanging zone by indirect heat exchange with a heat transfer cooling system, said heat exchanging zone comprising a plurality of sections, at least one of which sections is a one- or two-phase heat transfer section, and in which fouling deposits accumulate on the surfaces thereof at different rates in the various sections because of different conditions which occur in the sections and each section including rappers for removing said deposits;

(b) determining the overall heat transfer coefficient of said deposits for each section of said zone, said determining includes determining mass flow rates of said gas and cooling system within said heat exchanging zone, determining temperatures of said gas and cooling system within said heat exchanging zone, and determining heat fluxes of said gas and cooling system within said heat exchanging zone;

(c) determining the relative change of the overall heat transfer coefficient of the heat transfer surfaces, including any fouling deposits thereon for each section as a function of time;

(d) comparing the relative change of the overall heat transfer coefficient due to the change of the thickness of the fouling deposits for each section from (c) with a preselected reference section, said reference section being the section of least fouling and which is rapped based on its current overall heat transfer coefficient as compared to its initial overall heat transfer coefficient;

(e) removing said fouling deposits from each section of said zone using rapping means, said rapping means having separate and independently controllable rapping parameters for each section of said zone; and (f) adjusting said rapping parameters of each section of said zone based on (d), said adjusting includes one or more of (1) adjusting a time interval between rapping of individual rappers in said section, (2) adjusting rapping force of individual rappers, (3) adjusting the number of strikes of an individual rapper in its cycle, (4) adjusting the time interval for rapping an individual rapper, and (5) adjusting the time interval between complete rapping cycles of rappers in a said section.

2. A method for optimizing the operation of a heat exchanging zone used to cool a gas by controlled rapping to remove fouling deposits thereon, said method comprising:

(a) removing heat from a gas in said heat exchanging zone by indirect heat exchanging with a heat transfer cooling system, said heat exchanging zone comprising a plurality of sections, at least one of which sections is a one- or two-phase heat transfer section and in which fouling deposits accumulate on the surfaces thereof at different rates because of different conditions which occur in the sections, each section including rappers for removing said deposits;

(b) determining heat transfer coefficient of said deposits for each section of said zone, said determining includes determining mass flow rates of said gas and cooling system within said heat exchanging zone, determining temperatures of said product gas and cooling system within said heat exchanging zone and determining heat fluxes of said gas and cooling system within said heat exchanging zone;

(c) determining the relative change of the overall heat transfer coefficient of the heat transfer surfaces, including any fouling deposits thereon, for each section as a function of time;

(d) comparing the relative change of the overall heat transfer coefficient due to the change of the thickness of the deposits for each section from (c) with a preselected reference section, said reference section being the section of least fouling and which is rapped based on its current overall heat transfer coefficient as compared to its initial heat transfer coefficient;

(e) removing said fouling deposits from each section of said zone using rapping means, said rapping means having separate and independently controllable rapping parameters for each section of said zone; and (f) adjusting said rapping cycle parameters of each section of said zone based on (d), said adjusting includes one or more of (1) adjusting a time interval between rapping of individual rappers in said section, (2) adjusting rapping force of individual rappers, (3) adjusting the number of strikes of an individual rapper in its cycle, (4) adjusting the time interval for rapping an individual rapper, and (5) adjusting the time interval between complete rapping cycles of rappers in a said section.

3. A method for controlling rapping of heat exchanging surfaces used to cool gas having fouling deposits thereon said method comprising:

(a) removing heat from a gas in a heat exchanging zone by indirect heat exchange with a heat transfer cooling system, said heat exchanging zone comprising a plurality of sections at least one of which sections is a one- or two-phase heat transfer section, and in which fouling deposits accumulate on the surfaces thereof at different rates because of different conditions which occur in the sections and each section including rappers for removing said deposits;

(b) obtaining a signal relative to the overall heat transfer coefficient of the heat transfer surfaces, including any fouling deposits thereon, for each section of said zone, said obtaining includes obtaining signals relative to mass flow rates of said gas and cooling system within said heat exchanging zone, obtaining signals relative to temperatures of said gas and cooling system within said heat exchanging zone, obtaining signals relative to heat fluxes of said gas and cooling system within said heat exchanging zone;

(c) transmitting said signals relative to said overall heat transfer coefficients to a controlling means;

(d) determining the relative change of the overall heat transfer coefficient due to the change of the thickness of said fouling deposits for each section as a function of time using said controlling means;

(e) comparing the relative change of the overall heat transfer coefficient of each section from (d) with a preselected reference section, said reference section being the section of least fouling and which is rapped based on its current overall heat transfer coefficient as compared to its initial overall heat transfer coefficient;

(f) transmitting a signal from said controlling means to a rapping means for removing said fouling deposits;

(g) removing said fouling deposits from each section of said zone using rapping means, said rapping means having separate and independently controllable rapping parameters for each section of said zone; and (h) adjusting said rapping parameters of each section of said zone based on (d), said adjusting includes one or more of (1) adjusting a time interval between rapping of individual rappers in said section, (2) adjusting rapping force of individual rappers, (3) adjusting the number of strikes of an individual rapper in its cycle, (4) adjusting the time interval for rapping an individual rapper, and (5) adjusting the time interval between complete rapping cycles of rappers in a said section.

4. A method for optimizing the operation of a heat exchanging zone used to cool a gas by controlled rapping to remove fouling deposits thereon, said method comprising:

(a) removing heat from a gas in a heat exchanging zone by indirect heat exchange with a heat transfer cooling system, said heat exchanging zone comprising a plurality of sections, at least one of which sections is a one- or two-phase heat transfer section, and in which fouling deposits accumulate on the surfaces thereof at different rates because of different conditions which occur in the sections and each section including rappers for removing said deposits;

(b) obtaining a signal relative to overall heat transfer coefficient of the heat transfer surfaces, including any fouling deposits thereon, for each section of said zone, said obtaining includes obtaining signals relative to mass flow rates of said gas and cooling system within said heat exchanging zone, obtaining signals relative to temperatures of said gas and cooling system within said heat exchanging zone, obtaining signals relative to heat fluxes of said gas and cooling system within said heat exchanging zone;

(c) transmitting said signals relative to said overall heat transfer coefficients to a controlling means;

(d) determining the relative change of the overall heat transfer coefficient due to the change of the thickness of said fouling deposits for each section as a function of time using said controlling means;

(e) comparing the relative change of the overall heat transfer coefficient of each section from (d) with a preselected reference section, said reference section being the section of least fouling and which is rapped based on its current overall heat transfer coefficinet as compared to its initial overall heat transfer coefficient;

(f) transmitting a signal from said controlling means to a rapping means for removing said fouling deposits;

(g) removing said fouling deposits from each section of said zone using rapping means, said rapping means having separate and independently controllable rapping parameters for each section of said zone; and (h) adjusting said rapping parameters of each section of said zone based on (d), said adjusting includes one or more of (1) adjusting a time interval between rapping of individual rappers in said section, (2) adjusting rapping force of individual rappers, (3) adjusting the number of strikes of an individual rapper in its cycle, (4) adjusting the time interval for rapping an individual rapper, and (5) adjusting the time interval between complete rapping cycles of rappers in a said section.

5. A method for controlling removal of fouling deposits on heat exchanging surfaces used a cool gas said method comprising:

(a) removing heat from a gas in a heat exchanging zone by indirect heat exchange with a heat transfer cooling system, said heat exchanging zone comprising a plurality of sections at least one of which sections is a one- or two-phase heat transfer section, and in which fouling deposits accumulate on the surfaces thereof at different rates because of different conditions which occur in the sections and each section including rappers for removing said deposits;

(b) determining the overall heat transfer coefficient of the heat transfer surfaces, including any fouling deposits thereon, for each section of said zone;

(c) determining the relative change of the overall heat transfer coefficient due to the change of the thickness of said fouling deposits as a function of time;

(d) comparing the relative change of the overall heat transfer coefficient of each section from (c) with a preselected reference section, said reference section being the section of least fouling and which is rapped based on its current overall heat transfer coefficient as compared to its initial overall heat transfer coefficient; and (e) controlling said rappers for removing said fouling deposits from said sections of said zone.

6. The method of any of claim 1–5 wherein said gas is synthesis gas produced by operating a gasifier at a temperature of from about 2000° F. to about 3000° F.

7. The method of claim 6 wherein said synthesis gas from said gasifier is passed to a heat exchanging zone and includes passing said gas through a quench section, an open duct section, superheater section, evaporator section, and economizer section.

8. The method of claim 6 wherein removing heat from said gas includes operating at least one section of said zone of said cooling system at a temperature of from above about 1200° F. to about 1600° F.

9. The method of claim 6 wherein determining the overall heat transfer resistance includes determining mass flow rates of said synthesis gas and cooling system within said heat exchanging zone; determining temperatures of said synthesis gas and cooling system within said heat exchanging zone; and determining heat fluxes of said synthesis gas and cooling system within said heat exchanging zone.

10. The method of claim 5 wherein removing said fouling deposits includes removing deposits from each section of said zone using mechanical rapping means.

11. The method of claim 10 wherein using rapping means includes separately and independently controlling rapping parameters for each section of said zone.

12. The method of claims 10 or 11 wherein using rapping means includes adjusting rapping parameters.

13. The method of claim 12 wherein adjusting said rapping parameters of each section of said zone based on (d), said adjusting includes one or more of (1) adjusting a time interval between rapping of individual rappers in said section, (2) adjusting rapping force of individual rappers, (3) adjusting the number of strikes of an individual rapper in its cycle, (4) adjusting the time interval for rapping an individual rapper, and (5) adjusting the time interval between complete rapping cycles of rappers in a said section.

14. A method for optimizing the operation of a heat exchanging zone by removal of fouling deposits on heat exchanging surfaces, said method comprising:

(a) removing heat from a gas in a heat exchanging zone by indirect heat exchange with a heat transfer cooling system, said heat exchanging zone comprising a plurality of sections at least one of which sections is a one- or two-phase heat transfer section, and in which fouling deposits accumulate on the surfaces thereof at different rates because of different conditions which occur in the sections and each section including rappers for removing said deposits;

(b) determining the overall heat transfer coefficient of the heat transfer surfaces, including any fouling deposits thereon, for each section of said zone;

(c) determining the relative change of the overall heat transfer coefficient due to the change of the thickness of said fouling deposits as a function of time;

(d) comparing the relative change of the overall heat transfer coefficient of each section from (c) with a preselected reference section, said reference section being the section of least fouling and which is rapped based on its current overall heat transfer coefficient as compared to its initial overall heat transfer coefficient; and (e) controlling said rappers for removing said fouling deposits from said sections of said zone.

15. The method of claim 14 wherein said gas is passed from a reactor to a heat exchanging zone and includes passing said gas through at least one section adapted to generate superheated steam, and a lower temperature heat exchanging section.

16. The method of claim 14 wherein determining overall heat transfer coefficient includes determining the overall heat transfer coefficient of said deposits for each section of said zone.

17. The method of claims 14 or 16 wherein determining the overall heat transfer coefficient includes determining mass flow rates of said gas and cooling system within said heat exchanging zone, determining temperatures of said gas and cooling system within said heat exchanging zone, and determining heat fluxes of said gas and cooling system within said heat exchanging zone.

18. The method of claim 14 wherein removing said fouling deposits includes removing deposits from each section of said zone using mechanical rapping means.

19. The method of claim 18 wherein using rapping means includes separately and independently controlling rapping parameters for each section of said zone.

20. The method of claims 18 or 19 wherein using rapping means includes adjusting rapping parameters.

21. The method of claim 20 wherein adjusting said rapping parameters of each section of said zone based on (d), said adjusting includes one or more of (1) adjusting a time interval between rapping of individual rappers in said section, (2) adjusting rapping force of individual rappers, (3) adjusting the number of strikes of an individual rapper in its cycle, (4) adjusting the time interval for rapping an individual rapper, and (5) adjusting the time interval between complete rapping cycles of rappers in a said section.

22. A method for controlling removal of fouling deposits on heat exchanging surfaces used to cool synthesis gas within a synthesis gas system, said method comprising:

(a) removing heat from a gas in a heat exchanging zone by indirect heat exchange with a heat transfer cooling system, said heat exchanging zone comprising a plurality of sections, at least one of which sections is a one- or two-phase heat transfer section, and in which fouling deposits accumulate on the surfaces thereof at different rates because of different conditions which occur in the sections and each section including rappers for removing said deposits.

(b) obtaining signals relative to overall heat transfer coefficient of the heat transfer surfaces, including any fouling deposits thereon, for each section of said zone;

(c) transmitting said signals relative to said overall heat transfer coefficients to a controlling means;

(d) determining the relative change of the overall heat transfer coefficient due to the change of the thickness of said fouling deposits as a function of time using said controlling means;

(e) comparing the relative change of the overall heat transfer coefficient of each section from (d) with a preselected reference section using said controlling means, said reference section being the section of least fouling and which is rapped based on its current overall heat transfer coefficient as compared to its initial overall heat transfer coefficient; and (f) transmitting a signal from said controlling means to a means for removing fouling deposits;

23. The method of claim 22 wherein said gas is synthesis gas produced by operating said a gasifier at a temperature of from about 2000° F. to about 3000° F.

24. The method of claim 22 wherein said synthesis gas from said gasifier is passed to a heat exchanging zone and includes passing said gas through a quench section, an open duct section, superheater section, evaporator section, and economizer section.

25. The method of claim 22 wherein removing heat from said synthesis gas includes operating said at least one section of cooling zone of said system at a temperature of from above about 1200° F. to about 1600° F.

26. The method of claim 22 wherein obtaining signals relative to the overall heat transfer coefficient includes obtaining signals relative to mass flow rates of said synthesis gas and cooling system within said heat exchanging zone, obtaining signals relative to temperatures of said synthesis gas and cooling system within said heat exchanging zone, and obtaining signals relative to heat fluxes of said synthesis gas and cooling system within said heat exchanging zone.

27. The method of claim 22 wherein removing said deposits includes removing deposits from each section of said zone using mechanical rapping means.

28. The method of claim 27 wherein using rapping means includes separately and independently controlling rapping parameters for each section of said zone.

29. The method of claims 27 or 28 wherein using rapping means includes adjusting rapping parameters.

30. The method of claim 29 wherein adjusting said rapping parameters of each section of said zone based on (e), said adjusting includes one or more of (1) adjusting a time interval between rapping of individual rappers in said section, (2) adjusting rapping force of individual rappers, (3) adjusting the number of strikes of an individual rapper in its cycle, (4) adjusting the time interval for rapping an individual rapper, and (5) adjusting the time interval between complete rapping cycles of rappers in a said section.

31. A method for optimizing the operation of a heat exchanging zone used to cool a gas removal of fouling deposits from heat exchanging surfaces, said method comprising:

(a) removing heat from a gas in a heat exchanging zone by indirect heat exchange with a heat transfer cooling system, said heat exchanging zone comprising a plurality of sections at least one of which sections is a one- or two-phase heat transfer section, and in which fouling deposits accumulate on the surfaces thereof at different rates because of different conditions which occur in the sections and each section including rappers for removing said deposits;

(b) obtaining signals relative to the overall heat transfer coefficient of the heat transfer surfaces, including any fouling deposits thereon, for each section of said zone;

(c) transmitting said signals relative to said overall heat transfer coefficient to a controlling means;

(d) determining the relative change of the overall heat transfer coefficient due to change of the thickness of said fouling deposits as a function of time using controlling means;

(e) comparing the relative change of the overall heat transfer coefficient of each section from (c) with a preselected reference section, using controlling means, said reference section being the section of least fouling and which is rapped based on its current overall heat transfer coefficient as compared to its initial overall heat transfer coefficient; and (f) transmitting a signal from said controlling means to a means for removing said fouling deposits.

32. The method of claim 31 wherein said gas is passed from a reactor to a heat exchanging zone and includes passing said gas through at least one section adapted to generate superheated steam, and a lower temperature heat exchanging section.

33. The method of claim 31 wherein obtaining signals relative to said overall heat transfer coefficient includes obtaining signals relative to mass flow rates of said gas and cooling system within said heat exchanging zone, obtaining signals relative to temperatures of said gas and cooling system within said heat exchanging zone, and obtaining signals relative to heat fluxes of said gas and cooling system within said heat exchanging zone.

34. The method of claim 31 wherein removing deposits includes removing deposits from each section of said zone using mechanical rapping means.

35. The method of claim 34 wherein using rapping means includes separately and independently controlling rapping parameters for each section of said zone.

36. The method of claims 34 or 35 wherein using rapping means includes adjusting rapping parameters.

37. The method of claim 36 wherein adjusting said rapping parameters of each section of said zone based on (e), said adjusting includes one or more of (1) adjusting a time interval between rapping of individual rappers in said section, (2) adjusting rapping force of individual rappers, (3) adjusting the number of strikes of an individual rapper in its cycle, (4) adjusting the time interval for rapping an individual rapper, and (5) adjusting the time interval between complete rapping cycles of rappers in a said section.

38. The method according to any one of claims 1–5, 14, 22 or 31 wherein rapping of each section of the zone is in an adjusted sequential cycle which includes rapping of the other sections of the zone based on the relative change of the overall heat transfer coefficient due to changes of the thickness of the fouling deposits of each section as a function of time as compared to the other sections to optimize the overall rapping cycle of the heat exchanging zone.

39. The method according to any one of claims 1–5, 14, 22 or 31 wherein the overall heat transfer coefficient of a two-phase heat transfer section used to cool gas at above about 1200°–1400° F. is determined using a gamma-ray densitometer to determine the quality of the steam-water two-phase mixture.

40. An apparatus for controlling rapping of heat exchanging surfaces used to cool gas having fouling deposits thereon said apparatus comprising:

(a) means for removing heat from said gas in said heat exchanging zone with a heat transfer cooling system, said heat exchanging zone comprising a plurality of sections, at least one of which sections is a one-or two-phase heat transfer section, and in which fouling deposits accumulate on the surfaces thereof at different rates because of different conditions which occur in the sections, each section including rappers for removing said deposits;

(b) means for determining the overall heat transfer coefficient of the heat transfer surfaces, including any deposits thereon, for each section of said zone, said means for determining includes means for determining mass flow rates of said gas and cooling system within said heat exchanging zone, means for determining temperatures of said gas and cooling systems within said heat exchanging zone, means for determining heat fluxes of said gas and cooling system within said heat exchanging zone;

(c) means for determining the relative change of the overall heat transfer coefficient due to the change of the thickness of said fouling deposits for each section as a function of time;

(d) means for comparing the relative change of the overall heat transfer coefficient of each section from (c) with a preselected reference section, said reference section being the section of least fouling and which is rapped based on its current overall heat transfer coefficient as compared to its initial overall heat transfer coefficient;

(e) means for removing said fouling deposits from each section of said zone using rapping means, said rapping means having separate and independently controllable rapping parameters for each section of said zone; and (f) means for adjusting said rapping parameters of each section of said zone based on the determination of (d), said means for adjusting includes one or more of (1) means for adjusting a time interval between rapping of individual rappers in said section, (2) means for adjusting rapping force of individual rappers in its cycle, (3) means for adjusting the number of strikes of an individual rapper, (4) means for adjusting the time interval for rapping an individual rapper, and (5) means for adjusting the time interval between complete rapping cycles of rappers in said section.

41. An apparatus for optimizing the operation of a heat exchanging zone used to cool a gas by controlled rapping to remove fouling deposits thereon, said apparatus comprising:

(a) means for removing heat from said gas in said heat exchanging zone with a heat transfer cooling system, said heat exchanging zone comprising a plurality of sections, at least one of which sections is a one-or two-phase heat transfer section, in which sections fouling deposits accumulate on the surfaces thereof at different rates because of different conditions which occur in the sections, each section including rappers for removing said deposits;

(b) means for determining the overall heat transfer coefficient of the heat transfer surfaces, including any fouling deposits thereon, for each section of said zone, said means for determining includes means for determining mass flow rates of said product gas and cooling system within said heat exchanging zone, means for determining temperatures of said product gas and cooling system within said heat exchanging zone, means for determining heat fluxes of said product gas and cooling system within said heat exchanging zone;

(c) means for determining the relative change of the overall heat transfer coefficient due to the change of the thickness of said fouling deposits for each section as a function of time;

(d) means for comparing the relative change of the overall heat transfer coefficient of each section from (c) with a preselected reference section, said reference section being the section of least fouling and which is rapped based on its current overall heat transfer coefficient as compared to its initial overall heat transfer coefficient;

(e) means for removing fouling deposits from each section of said zone using rapping means, said rapping means having separate and independently controllable rapping parameters for each section of said zone; and (f) means for adjusting said rapping parameters of each section of said zone based on the determination of (d), said means for adjusting includes one or more of (1) means for adjusting a time interval between rapping of individual rappers in said section, (2) means for adjusting rapping force of individual rappers, (3) means for adjusting the number of strikes of an individual rapper in its cycle, (4) means for adjusting the time interval for rapping an individual rapper, and (5) means for adjusting the time interval between complete rapping cycles of rappers in said section.

42. An apparatus for controlling rapping of heat exchanging surfaces used to cool a gas having fouling deposits thereon within a synthesis gas system, said apparatus comprising:

(a) means for removing heat from said gas in said heat exchanging zone with a heat transfer cooling system, said heat exchanging zone comprising a plurality of sections, at least one of which sections is a one-or two-phase heat transfer section, and in which fouling deposits accumulate on the surfaces thereof at different rates because of different conditions which occur in the sections, each section including rappers for removing said deposits;

(b) means for obtaining a signal relative to overall heat transfer coefficient of the heat transfer surface, including any fouling deposits thereon, for each section of said zone, said means for obtaining includes means for obtaining signals relative to mass flow rates of said gas and cooling system within said heat exchanging zone, means for obtaining signals relative to temperatures of said gas and cooling system within said heat exchanging zone, means for obtaining signals relative to heat fluxes of said gas and cooling system within said heat exchanging zone;

(c) means for transmitting said signals relative to said overall heat transfer coefficient to a controlling means;

(d) means for determining the change of the overall heat transfer coefficient due to the change of the thickness of said fouling deposits for each section as a function of time using said controlling means;

(e) means for comparing the relative change of the overall heat transfer coefficient of each section from (c) with a preselected reference section using said controlling means, said reference section being the section of least fouling and which is rapped based on its current overall heat transfer coefficient as compared to its initial overall heat transfer coefficient;

(f) means for transmitting a signal from said controlling means to a means for removing said fouling deposits;

(g) means for removing said fouling deposits from each section of said zone using rapping means, said rapping means having separate and independently controllable rapping parameters for each section of said zone; and (h) means for adjusting said rapping parameters of each section of said zone based on the determination of (d), said means for adjusting includes one or more of (1) means for adjusting a time interval between rapping of individual rappers in said section, (2) means for adjusting rapping force of individual rappers in its cycle, (3) means for adjusting the number of strikes of an individual rapper, (4) means for adjusting the time interval for rapping an individual rapper, and (5) means for adjusting the time interval between complete rapping cycles in said section.

43. An apparatus for optimizing the operation of a heat exchanging zone used to cool a gas by controlled rapping to remove having fouling deposits thereon, said apparatus comprising:

(a) means for removing heat from said gas in said heat exchanging zone with a heat transfer cooling system, said heat exchanging zone comprising a plurality of sections, at least one of which sections is a one-or two-phase heat transfer section, and in which fouling deposits accumulate on the surfaces thereof at different rates because of different conditions which occur in the sections, each section including rappers for removing said deposits;

(b) means for obtaining a signal relative to overall heat transfer coefficient of the heat transfer surfaces, including any fouling deposits thereon, for each section of said zone, said means for obtaining includes means for obtaining signals relative to mass flow rates of said gas and cooling system within said heat exchanging zone, means for obtaining signals relative to temperatures of said gas and cooling system within said heat exchanging zone, means for obtaining signals relative to heat fluxes of said gas and cooling system within said heat exchanging zone;

(c) means for transmitting said signals relative to said overall heat transfer coefficient to a controlling means;

(d) means for determining the relative change of the overall heat transfer coefficient due to the change of the thickness of said fouling deposits for each section as a function of time using said controlling means;

(e) means for comparing the relative change of the overall heat transfer coefficient of each section from (c) with a preselected reference section using said controlling means, said reference section being the section of least fouling and which is rapped based on its current overall heat transfer coefficient as compared to its initial overall heat transfer coefficient;

(f) means for transmitting a signal from said controlling means to a means for removing said fouling deposits;

(g) means for removing said fouling deposits from each section of said zone using rapping means, said rapping means having separate and independently controllable rapping parameters for each section of said zone; and (h) means for adjusting said rapping parameters of each section of said zone based on the determination of (d), said means for adjusting includes one or more of (1) means for adjusting a time interval between rapping of individual rappers in said section, (2) means for adjusting rapping force of individual rappers, (3) means for adjusting the number of strikes of an individual rapper in its cycle, (4) means for adjusting the time interval for rapping an individual rapper, and (5) means for adjusting the time interval between complete rapping cycles of rappers in said section.

44. An apparatus for controlling removal of fouling deposits on heat exchanging surfaces used to cool gas, said apparatus comprising:

(a) means for removing heat from said synthesis gas in said heat exchanging zone by indirect heat exchanging with a heat transfer cooling system, said heat exchanging zone comprising a plurality of sections, at least one of which sections is a one- or two-phase heat transfer section, and in which fouling deposits accumulate on the surfaces thereof at different rates because of different conditions which occur in the sections and each section including rappers for removing said deposits;

(b) means for determining the overall heat transfer coefficient of the heat transfer surfaces, including any fouling deposits thereon, for each section of said zone;

(c) means for determining the relative change of the overall heat transfer coefficient due to the change of the thickness of said fouling deposits as a function of time;

(d) means for comparing the relative change of the overall heat transfer coefficient of each section from (c) with a preselected reference section, said reference section being the section of least fouling and which is rapped based on its current overall heat transfer coefficient as compared to its initial overall heat transfer coefficient; and (e) means for controlling said rappers for removing said fouling deposits from said sections of said zone.

45. The apparatus of claim 44 wherein means is provided for producing synthesis gas and includes means for operating a gasifier at a temperature of from about 2000° F. to about 3000° F.

46. The apparatus of claim 45 wherein means for passing said synthesis gas from said gasifier to a heat exchanging zone includes means for passing said gas through a quench section, an open duct section, gas reversal section, superheater section, evaporator section, and economizer section.

47. The apparatus of claim 44 wherein means for removing heat from said synthesis gas includes means for operating said at least one section of cooling zone of said system at a temperature of from above about 1200° F. to about 1600° F.

48. The apparatus of claim 44 wherein means for determining overall heat transfer coefficient includes means for determining mass flow rates of said synthesis gas and cooling system within said heat exchanging zone; means for determining temperatures of said synthesis gas and cooling system within said heat exchanging zone; and means for determining heat fluxes of said synthesis gas and cooling system within said heat exchanging zone.

49. The apparatus of claim 44 wherein means for removing said fouling deposits includes means for removing deposits from each section of said zone using mechanical rapping means.

50. The apparatus of claim 49 wherein rapping means includes means for separately and independently controlling rapping parameters of each section of said zone.

51. The apparatus of claims 49 or 50 wherein rapping means includes means for adjusting rapping parameters.

52. The apparatus of claim 51 wherein means for adjusting means for adjusting said rapping parameters of each section of said zone based on the determination of (d), said means for adjusting includes one or more of (1) means for adjusting a time interval between rapping of individual rappers in said section, (2) means for adjusting rapping force of individual rappers in its cycle, (3) means for adjusting the number of strikes of an individual rapper, (4) means for adjusting the time interval for rapping an individual rapper, and (5) means for adjusting the time interval between complete rapping cycles of rappers in said section.

53. An apparatus for optimizing the operation of a heat exchanging zone used to cool a gas by removal of fouling deposits on heat exchanging surfaces, said apparatus comprising:

(a) means for removing heat from said gas in said heat exchanging zone by indirect heat exchange, said heat exchanging zone comprising a plurality of sections, at least one of which is a one- or two-phase heat transfer section, and in which sections fouling deposits accumulate on the surfaces thereof at different rates because of different conditions which occur in the sections and each section includes rappers for removing said deposits;

(b) means for determining the overall heat transfer coefficient of the heat transfer surfaces, including any fouling deposits thereon, for each section of said zone;

(c) means for determining the relative change of the overall heat transfer coefficient of said fouling deposits as a function of time;

(d) means for comparing the relative change of the overall heat transfer coefficient of each section from (c) with a preselected reference section, said reference section being the section of least fouling and which is rapped based on its current overall heat transfer coefficient as compared to its initial overall heat transfer coefficient; and (e) means for controlling said rappers for removing said fouling deposits from said sections of said zone.

54. The apparatus of claim 53 wherein means for passing said gas from a reactor to a heat exchanging zone includes means for passing said gas through at least one section adapted to generate superheated steam, and a lower temperature heat exchanging section.

55. The apparatus of claim 53 wherein means for determining the overall heat transfer coefficient includes means for determining the overall heat of said deposits for each section of said zone.

56. The apparatus of claims 54 or 55 wherein means for determining the overall heat transfer coefficient includes means for determining mass flow rates of said gas and cooling system within said heat exchanging zone, means for determining temperatures of said gas and cooling system within said heat exchanging zone, and means for determining heat fluxes of said gas and cooling system within said heat exchanging zone.

57. The apparatus of claim 54 wherein means for removing said fouling deposits includes means for removing deposits from each section of said zone using mechanical rapping means.

58. The apparatus of claim 57 wherein rapping means includes means for separately and independently controlling rapping parameters for each section of said zone.

59. The apparatus of claims 57 or 58 wherein rapping means includes means for adjusting rapping parameters.

60. The apparatus of claim 59 wherein means for adjusting means for adjusting said rapping parameters of each section of said zone based on the determination of (d), said means for adjusting includes one or more of (1) means for adjusting a time interval between rapping of individual rappers in said section, (2) means for adjusting rapping force of individual rappers, (3) means for adjusting the number of strikes of an individual rapper in its cycle, (4) means for adjusting the time interval for rapping an individual rapper, and (5) means for adjusting the time interval between complete rapping cycles of rappers in said section.

61. An apparatus for controlling removal of fouling deposits on heat exchanging surfaces used a cool said apparatus comprising:

(a) means for removing heat from said gas in said heat exchanging zone with a heat transfer cooling system, said heat exchanging zone comprising a plurality of sections, at least one of which sections is a one-or two-phase heat transfer section, and in which fouling deposits accumulate on the surfaces thereof at different rates because of different conditions which occur in the sections, each section including rappers for removing said deposits;

(b) means for obtaining signals relative to the overall heat transfer coefficient of the heat transfer surfaces, including any fouling deposits thereon, for each section of said zone;

(c) means for transmitting said signals relative to said overall heat transfer coefficient to a controlling means;

(d) means for determining the relative change in the overall heat transfer coefficient due to the change of the thickness of said fouling deposits as a function of time using said controlling means;

(e) means for comparing the relative change of the overall heat transfer coefficient of each section from (d) with a preselected reference section, said reference section being the section of least fouling and which is rapped based on its current overall heat transfer coefficient as compared to its initial overall heat transfer coefficient; and (f) means for transmitting a signal from said controlling means to a means for removing fouling deposits.

62. The apparatus of claim 61 wherein means is provided for producing synthesis gas and includes means for operating said gasifier at a temperature of from about 2000° F. to about 3000° F.

63. The apparatus of claim 61 wherein means for passing said synthesis gas from said gasifier to a heat exchanging zone includes means for passing said gas through a quench section, an open duct section, superheater section, evaporator section, and economizer section.

64. The apparatus of claim 61 wherein means for removing heat from said synthesis gas includes means for operating at least one section of said cooling zone of said system at a temperature of from above about 1200° F. to about 1600° F.

65. The apparatus of claim 61 wherein means for obtaining signal relative to the overall heat transfer coefficient includes means for obtaining signals relative to mass flow rates of said gas and cooling system within said heat exchanging zone, means for obtaining signals relative to temperatures of said gas and cooling system within said heat exchanging zone, and means for obtaining signals relative to heat fluxes of said gas and cooling system within said heat exchanging zone.

66. The apparatus of claim 61 wherein means for removing said deposits includes means for removing deposits from each section of said zone using mechanical rapping means.

67. The apparatus of claim 66 wherein rapping means includes means for separately and independently controlling rapping parameters for each section of said zone.

68. The apparatus of claims 66 or 67 wherein rapping means includes means for adjusting rapping parameters.

69. The apparatus of claim 68 wherein means for adjusting means for adjusting said rapping parameters of each section of said zone based on the determination of (d), said means for adjusting includes one or more of (1) means for adjusting a time interval between rapping of individual rappers in said section, (2) means for adjusting rapping force of individual rappers, (3) means for adjusting the number of strikes of an individual rapper, in its cycle (4) means for adjusting the time interval for rapping an individual rapper, and (5) means for adjusting the time interval between complete rapping cycles of rappers in said section.

70. An apparatus for optimizing the operation of a heat exchanging zone used to cool a gas by removal of fouling deposits from heat exchanging surfaces, said apparatus comprising:

(a) means for removing heat from said gas in said heat exchanging zone with a heat transfer cooling system, said heat exchanging zone comprising a plurality of sections, at least one of which sections is a one-or two-phase heat transfer section, and in which fouling deposits accumulate on the surfaces thereof at different rates because of different conditions which occur in the sections, each section including rappers for removing said deposits;

(b) means for obtaining signals relative to the overall heat transfer coefficient of the heat transfer surfaces, including any fouling deposits thereon, for each section of said zone;

(c) means for transmitting said signals relative to said overall heat transfer resistances to a controlling means;

(d) means for determining the relative change of the overall heat transfer coefficient due to the change of the thickness of said fouling deposits as a function of time using controlling means;

(e) means for comparing the relative change of the overall heat transfer coefficient of each section from (d) with a preselected reference section using said controlling means, said reference section being the section of least fouling and which is rapped based on its current overall heat transfer coefficient as compared to its initial overall heat transfer coefficient; and (f) means for transmitting a signal from said controlling means to a means for removing said fouling deposits.

71. The apparatus of claim 70 wherein means for passing said product gas from a reactor to a heat exchanging zone includes means for passing said gas through at least one section adapted to generate superheated steam, and a lower temperature heat exchanging section.

72. The apparatus of claim 70 wherein means for obtaining signals relative to the overall heat transfer coefficient includes means for obtaining signals relative to mass flow rates of said product gas and cooling system within said heat exchanging zone, means for obtaining signals relative to temperatures of said gas and cooling system within said heat exchanging zone, and means for obtaining signals relative to heat fluxes of said gas and cooling system within said heat exchanging zone.

73. The apparatus of claim 70 wherein means for removing said deposits includes means for removing deposits from each section of said zone using mechanical rapping means.

74. The apparatus of claim 73 wherein rapping means includes means for separately and independently controlling rapping parameters for each section of said zone.

75. The apparatus of claims 73 or 74 wherein rapping means includes means for adjusting rapping parameters.

76. The apparatus of claim 75 wherein means for adjusting rapping of each section of said zone based on (e), said adjusting includes one or more of (1) means for adjusting a time interval between rapping, (2) means for adjusting rapping force of individual rappers and (3) means for adjusting the number of strikes of an individual rapper, (4) means for adjusting the time interval for rapping an individual rapper and (5) means for adjusting the time interval between complete rapping cycles in a said section.

77. The apparatus according to any one of claims 40–44, 53, 61 or 70 which includes means for adjusting the rapping each section of the zone in an adjusted sequential cycle with which includes rapping of the other sections of the zone based on the relative changes of the overall heat transfer coefficient due to the change of the thickness of the fouling deposits of each section as a function of time as compared to the other sections to optimize the overall rapping cycle of the heat exchanging zone.

78. The apparatus according to any one of claims 40–44, 53, 61 or 71 which includes a gamma-ray densitometer to determine the overall heat transfer coefficient of a two-phase heat transfer section used to cool gas at above about 1200°–1400° F. by determining the quality of the steam-water two-phase mixture.

* * * * *